United States Patent [19]

Jilek et al.

[11] Patent Number: 4,565,355

[45] Date of Patent: Jan. 21, 1986

[54] FLUSHING ARRANGEMENT FOR A METALLURGICAL VESSEL

[75] Inventors: Walter Jilek; Günter Poferl, both of Linz, Austria

[73] Assignee: Voest-Alpine Aktiengesellschaft, Linz, Austria

[21] Appl. No.: 624,985

[22] Filed: Jun. 27, 1984

[30] Foreign Application Priority Data

Mar. 15, 1984 [AT] Austria ..... 865/84

[51] Int. Cl.[4] ..... C21C 5/34

[52] U.S. Cl. ..... 266/224; 266/266

[58] Field of Search ..... 266/220, 224, 265, 266, 266/270

[56] References Cited

U.S. PATENT DOCUMENTS

| | | | |
|---|---|---|---|
| 4,340,208 | 7/1982 | Vayssiere et al. | 266/220 |
| 4,378,106 | 3/1983 | Hirschberg et al. | 266/265 |
| 4,395,026 | 7/1983 | Hödl et al. | 266/265 |
| 4,403,768 | 9/1983 | Grosjean et al. | 266/270 |
| 4,413,815 | 11/1983 | Duhomez et al. | 266/266 |

FOREIGN PATENT DOCUMENTS

| | | | |
|---|---|---|---|
| 265341 | 1/1968 | Austria . | |
| 849446 | 8/1970 | Canada | 266/220 |
| 0032350 | 8/1981 | European Pat. Off. . | |
| 865524 | 9/1981 | U.S.S.R. | 266/220 |

OTHER PUBLICATIONS

Vol. 3, Radex Rundschau, pp. 499–517, (1981), Hütter et al.

*Primary Examiner*—L. Dewayne Rutledge
*Assistant Examiner*—Robert L. McDowell
*Attorney, Agent, or Firm*—Brumbaugh, Graves, Donohue & Raymond

[57] ABSTRACT

In a flushing arrangement for a metallurgical vessel, a metallic flushing plate is installed on pre-determined sites of the bottom or the vessel walls between neighboring refractory bricks. The flushing plate has two plate-shaped metal walls delimiting at least one passage channel for flush gas, and a supply duct, in flow connection with the passage channel.

12 Claims, 6 Drawing Figures

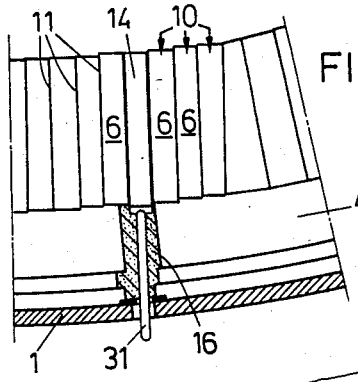
FIG. 2
FIG. 1
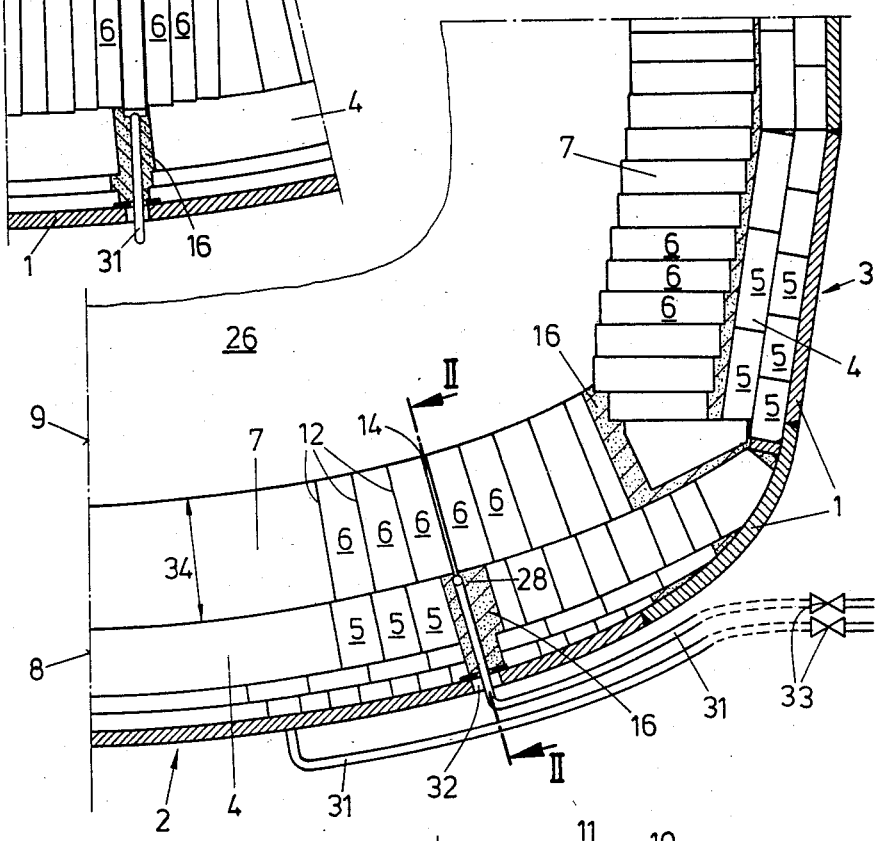
FIG. 3
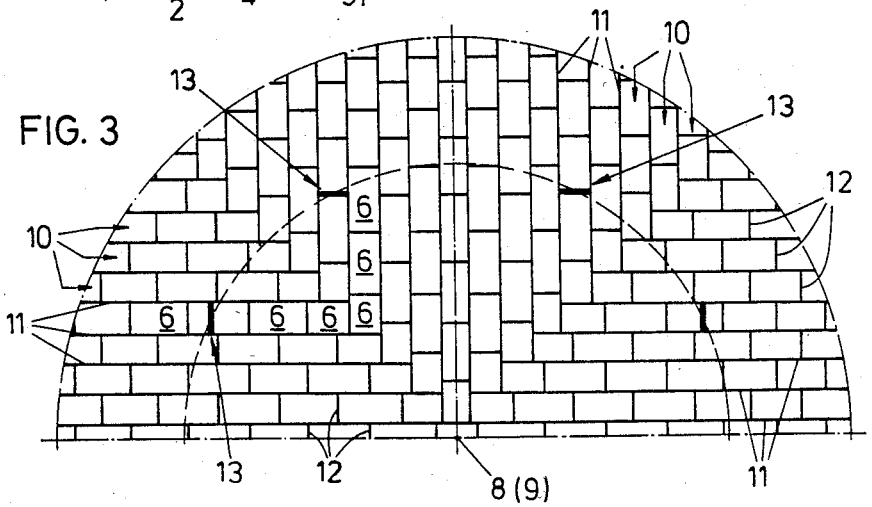

FLUSHING ARRANGEMENT FOR A METALLURGICAL VESSEL

BACKGROUND OF THE INVENTION

The invention relates to a flushing arrangement for a metallurgical vessel whose bottom and walls are lined by refractory bricks arranged in rows.

By blowing flush gas into a metal melt, e.g., through the bottom of a metallurgical vessel, a stirring effect may be achieved in the metal melt, by which imbalances of composition and temperature are balanced out, the separation of non-metallic inclusions is effected and a certain degassing of the metal melt is promoted.

For introducing flush gas, a plurality of arrangements are known. Thus, e.g., Radex Rundschau, Vol. 3, 1981, p. 499 to 517; European patent application No. 0 053 554 and European patent application No. 0 032 350 show gas-permeable, refractory converter flushing bricks to be known, where such a gas flushing brick is inserted instead of a brick of the refractory lining of the converter. The flushing brick, includes a porous refractory mass with a sheet or plate jacket for avoiding a lateral gas emergence, the porous mass possibly having a directed porosity, thus replaces a conventional brick of the inner lining of the converter. The sheet or plate jacket is open towards the inner space of the converter, and at the oppositely directed end of the flushing brick, at which the sheet or plate jacket is closed, a supply duct is connected to the sheet or plate jacket in a gas-tight manner. Flushing bricks of this type have the disadvantage that they are complicated with regard to their production and installation and that an uncontrolled gas penetration may occur between the sheet or plate jacket and the porous, refractory mass contained therein, if the refractory mass does not completely abut the sheet or plate jacket. Furthermore, such a flushing brick is worn more quickly than the inner lining of the converter, necessitating repair measures costly with regard to material and time between two relinings of the inner lining.

Furthermore, it is known (Austrian patent No. 265,341) to embed a nozzle tube in a refractory flushing brick, which has, however, the disadvantage that the flushing brick, which also is inserted instead of a conventional brick of the refractory lining of the converter, must always be supplied with a certain minimum amount of flush gas as long as the flushing brick is covered by melt in order to prevent a clogging of the nozzle tube due to the penetration of melt.

Furthermore, it is known (European patent application No. 0 043 338, European patent application No. 0 021 861 and European patent application No. 0 043 787) to form a flushing brick of a number of refractory individual parts having a slight or no porosity, wherein the individual parts are held together by a sheet or plate jacket to form a so-called sandwich-flushing brick, which is also installed instead of a conventional brick of the refractory lining of the converter. In the abutting surfaces of the refractory individual parts longitudinal grooves or profiled metal inlays are provided, by which the cavities conducting the flush gas are formed. In addition to the fact that such a sandwich-flushing brick is also very complicated and expensive in its production, it has the disadvantage that a change in the gas permeability may occur during the time of its use, if an individual part becomes detached from its neighbouring individual part or from the sheet or plate jacket. Furthermore, early wear cannot be avoided, since the refractory individual parts have a composition different from that of the refractory bricks of the inner lining.

SUMMARY OF THE INVENTION

The invention aims at avoiding these disadvantages and difficulties and has as its object to provide a flushing arrangement which makes it possible to form the complete lining of the metallurgical vessel of conventional, refractory bricks so as to ensure a uniform wear without premature repairs necessitated by the flushing arrangement, wherein flushing may selectively be turned off despite the presence of melt, and wherein furthermore a constant, controlled flow of the flush gas is ensured during the operating time of the metallurgical vessel between two relinings of the inner lining.

According to the invention, this object is achieved in that at pre-determined sites of the bottom and/or the walls, between neighbouring refractory bricks a metallic flushing plate is installed which is provided with at least one, preferably a plurality of, passage channel or channels for flush gas delimited by two plate-shaped metal walls and in flow-connection with a supply duct.

A preferred embodiment is characterized in that a flushing plate is formed by two interconnected sheet or plate plates kept at a distance by spacer ribs, the hollow spaces between the spacer ribs and the sheet or plate plates forming slot-like passage channels connected by a distributor fed by a flush gas and provided at one end of the flushing plate, into which distributor the supply duct enters.

Suitably, the distributor of the flushing plate is formed by a pipe provided with a slot in its longitudinal direction, which pipe extends transversely to the passage channels, and the sheet or plate plates are connected with the rims of the slot in a gas-tight manner, whereby the production of the flushing plate becomes particularly simple.

In order to safely prevent a penetration of the melt into a passage channel, the passage channels have a maximum dimension of 1.5 mm in the direction of the thickness of the flushing plates.

Advantageously, the extension of a flushing plate in the longitudinal direction of the passage channels corresponds to the height of the refractory inner lining of the metallurgical vessel, and the distributor of the flushing plate is arranged in the outer lining of the metallurgical vessel arranged therebehind, whereby even when the inner lining is greatly worn, i.e. at the end of a converter campaign, gas flushings may be effected in a faultless manner.

Suitably, the shape of the flushing plate corresponds to the contour of the neighbouring, adjoining side faces of the refractory bricks. This measure makes the installation of the flushing plate particularly simple.

Suitably, the cross-section of the passage channels is constant over the entire extension of the flushing plate in the longitudinal direction of the passage channels, so that, even if the width of the flushing plate changes in the course of its length—i.e. when it is installed between conical refractory bricks, so-called end-arch bricks or spherical arch bricks—a constant amount of gas per time unit can be fed to the interior of the metallurgical vessel even after a burn-up of the flushing plate corresponding to the wear of the inner lining.

A preferred embodiment is characterized in that with an offset arrangement of the bricks in neighbouring rows, the flushing plates are each arranged in a predetermined transverse joint of a row, whereby it is possible to provide a flushing plate without special construction measures and without enlarging the distance between the rows of the refractory bricks.

Preferably, the flushing plate is welded at its rims in a gas-tight manner.

Suitably, the supply to each flushing plate is separately controllable.

BRIEF DESCRIPTION OF THE DRAWINGS

The invention will now be explained in more detail and with reference to the accompanying drawings of an exemplary embodiment, wherein FIG. 1 is a longitudinal section through a steel works converter, FIG. 2 is a section according to line II—II of FIG. 1, and FIG. 3 is a top view of the bottom of the steel works converter illustrated in FIGS. 1 and 2;

DETAILED DESCRIPTION OF THE INVENTION

Figure 4:
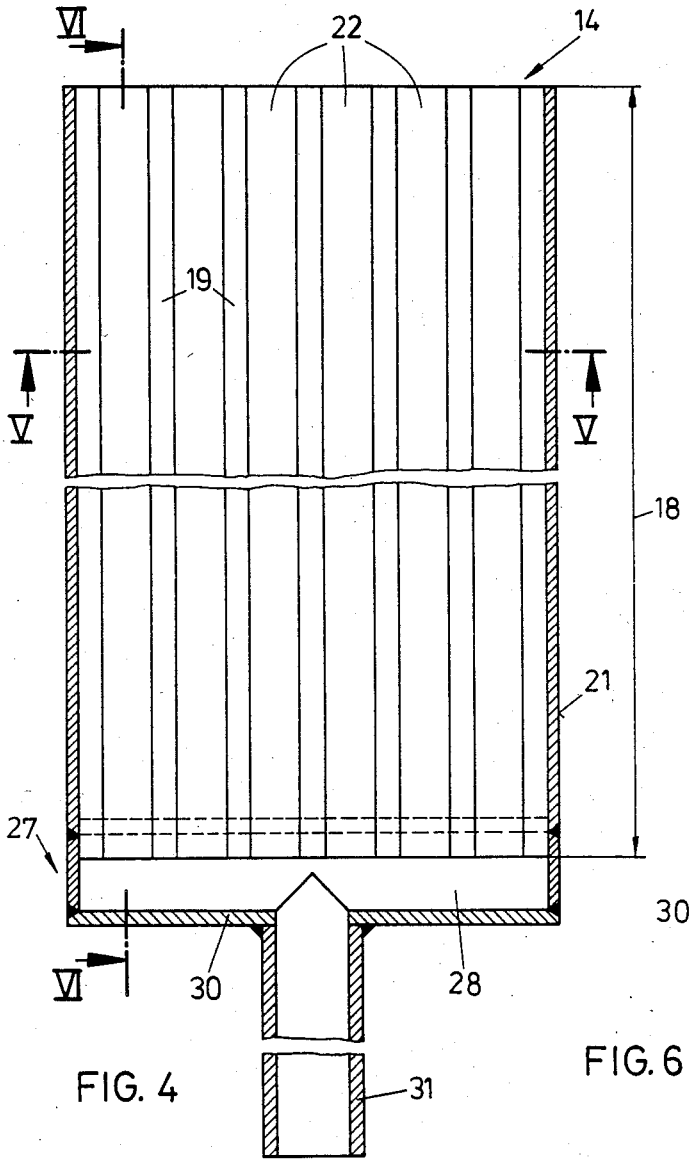
FIG. 4 is a longitudinal section through a flushing plate, the longitudinal section being made parallel to the plane of the flushing plate.
Figure 6:
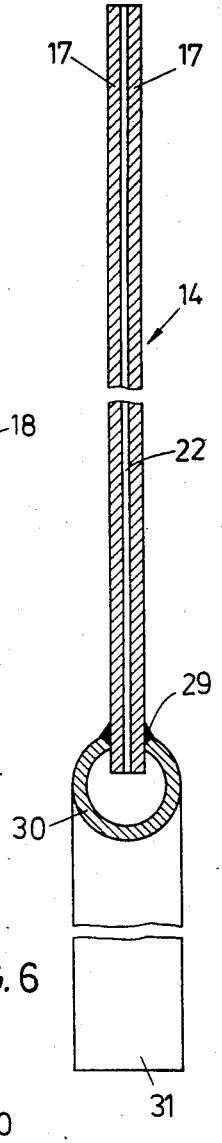
FIG. 6 is a section along line VI—VI of FIG. 4.

The steel works converter illustrated in FIG. 1 has a metal outer shell 1, which, at its inner side, is provided with an outer lining 4 on its bottom 2 as well as on its side walls 3. Onto the outer lining formed by refractory bricks 5, there is masoned an inner lining 7 also produced of refractory bricks 6. As can be seen from FIG. 3, the refractory bricks 6 of the inner lining 7 are arranged in rows 10 emanating in star shape from the center 8 of the bottom 2 or the longitudinal axis 9 of the converter, the rows 10 being parallel and adjoining each other with longitudinal joints 11 with the bricks 6 of neighbouring rows 10 being arranged offset to one another. The neighbouring bricks 6 of each row form transverse joints 12 ending in the longitudinal joints 11 between neighbouring rows 10 and each abutting a side face of a brick of a neighbouring row 10.

At pre-determined sites 13 in the bottom 2, which preferably are also spaced at approximately equal distances from the center 8 of the bottom 2 and also at approximately equal distances from each other, one flushing plate 14 each is inserted in transverse joints 12, the total thickness 15 of the flushing plate, i.e., its dimension directed transversely to the plane of the transverse joint 12, being very slight, so that the flushing plate 14 causes only a slight offsetting of the bricks 6 of a row 10 which can be balanced out by the ramming mass 16 introduced between the bottom 2 and the side wall 3 of the converter.

Each flushing plate 14 is formed by two sheet or plate plates 17 arranged parallel to each other, which are kept at a distance 20 from each other by spacer ribs 19 extending over the length 18 of the flushing plate 14. At the longitudinal side rims 21 the sheet or plate plates 17 are welded together in a gas-tight manner.

Figure 5:
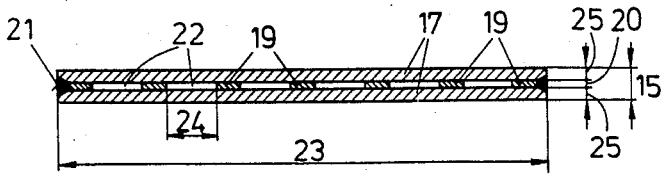
FIG. 5 is a section along line V—V of FIG. 4.

Between the spacer ribs 19 and the sheet or plate plates 17, cavities extending in the longitudinal direction of the spacer ribs 19 are formed, which are passage channels 22 for a flush gas. As becomes particularly apparent from FIG. 5, the passage channels 22 are slot-shaped, i.e. in the direction of the thickness 15 of the flushing plate 14 they have only a very slight dimension 20, preferably a dimension smaller than or equal to 1.5 mm, whereas in the direction of the width 23 of the flushing plate 14 they have a larger dimension 24, preferably a dimension of between 5 and 25 mm. The thickness 25 of the sheet or plate plates amounts to approximately 2.5 mm, preferably it is between 1.5 and 4.5 mm. Thus, the flushing plate has a total thickness 15 of between 4 and maximally 10.5 mm.

At its end 27 facing away from the converter interior 26, the flushing plate 14 is equipped with a distributor 28 formed by a pipe 30 provided with a slot 29 extending in its longitudinal direction. Into this slot 29 the two interconnected sheet or plate plates 17 are inserted and welded together with the rims of the slot 29 in a gas-tight manner. The pipe 30 forming the distributor and being closed on its ends thus extends transversely to the longitudinal direction of the passage channels 22. A further pipe 31 forming a supply duct is welded into the distributor, which further pipe is guided through an opening 32 of the converter shell to the outside.

The supply ducts 31 guided through the converter carrying trunnions advantageously are each provided with separate, stationarily arranged control valves 33, whereby it is possible to supply each flushing plate 14 with flush gas separately and independently of the other flushing plates 14.

The length 18 of each flushing plate 14, i.e. the extension of the flushing plate 14 in the longitudinal direction of the passage channels 22, corresponds to the height 34 of the bricks 6 forming the inner lining, at relining as well as during the burn-up of the flushing plate with the wear of the working lining 7 during operation. The distributor 28 is arranged in the outer lining 4, i.e. in a cavity thereof which is filled with ramming mass 16.

The width 23 and the length 18 of the flushing plate 14 preferably correspond exactly to the neighbouring adjoining side faces of the refractory bricks 6 forming a transverse joint 12, so that after insertion of a flushing plate 14 in a transverse joint 12 between the bricks 6 no free space is present. If the adjoining side faces of the bricks have a conical, i.e. trapezoidal, shape, then suitably the flushing plate has the same shape. In that case it is possible to dimension the channels so as to have the smallest cross-section at the exit openings and the largest cross-sections at the distributor, wherein it is, however, necessary in order to maintain constant the amount of flush gas, in case of a burn-up of the flushing plate 14, to control the same by means of the control valves 33 in dependence on this burn-up and in dependence on the wear of the inner lining 7. In order to avoid this, it is also possible to dimension the spacer ribs in a manner that the cross-section of the passage channels is constant over the length 18 of the flushing plate 14.

The invention is not limited to the exemplary embodiment described above, but is modifiable in various respects. Thus it is possible to vary the number of passage channels 22 within a wide range, just as the cross-sectional shape of the passage channels 22 may be varied. The spacer ribs 19 may also be formed by embossings of the sheet or plate plates 17. Furthermore, it is possible to form the passage channels 22 by flat-rolled pipes, the pipes being joined at their narrow sides so as to form a flushing plate. A flushing plate 14 need not necessarily extend over the entire width of a transverse joint 12, but may also extend over only half of it, e.g., two flushing plates 14 being provided in that case for each transverse joint 12, one beside the other and abutting with their rims 21. Furthermore, for reducing the number of supply ducts 31 it is possible to design the flushing plates with such a width 23 that they extend transversely to two rows of refractory bricks. If the bricks are arranged offset, one brick of a row must be split for forming a correspondingly wide transverse joint.

The flushing plate 14 preferably is made of conventional structural steel of middle strength. For special fields of utilization it is, however, also possible to produce the flushing plate of steel having high strength at elevated temperatures.

What we claim is:

1. In a flushing arrangement for a metallurgical vessel having a metallic outer shell including a vessel bottom and vessel walls, said vessel bottom and vessel walls being lined with refractory bricks arranged in rows so as to constitute an outer lining and an inner lining provided on said outer lining, a distributor and a plurality of flushing channels departing from said distributor and guided through said inner lining, the improvement wherein said flushing arrangement comprises a metallic flushing plate disposed between neighboring refractory bricks of said inner lining and having a plurality of passage channels for flush gas, said distributor being arranged in said outer lining, said flushing plate extending directly into said distributor, and a supply duct passing through said metallic outer shell of said vessel to said distributor.

2. A flushing arrangement as set forth in claim 1, wherein said two plate-shaped metal walls of said flushing plate are two interconnected sheet or plate plates, and wherein spacer ribs are provided for keeping said two sheet or plate plates at a distance from each other, said plurality of passage channels being formed by slot-shaped cavities formed between said spacer ribs and said two sheet or plate plates.

3. A flushing arrangement as set forth in claim 2, wherein said distributor is formed by a tube having a slot in its longitudinal direction, said tube extending transverse to said passage channels, and wherein said two sheet or plate plates are connected with the rims of said slot in a gas-tight manner.

4. A flushing arrangement as set forth in claim 1, wherein each passage channel has a dimension of maximally 1.5 mm in the direction of the thickness of said flushing plate.

5. A flushing arrangement as set forth in claim 2, wherein said flushing plate has an extension in the longitudinal direction of said passage channels corresponding to the height of said refractory inner lining.

6. A flushing arrangement as set forth in claim 1, wherein said flushing plate has a shape corresponding to the contour of the neighbouring adjoining side faces of said refractory bricks.

7. A flushing arrangement as set forth in claim 1, wherein each passage channel has a cross-section constant over the entire extension of the flushing plate directed in the longitudinal direction of said passage channel.

8. A flushing arrangement as set forth in claim 1, wherein said refractory bricks of neighbouring rows are arranged so as to be offset and each flushing plate is arranged in a pre-determined transverse joint of a row.

9. A flushing arrangement as set forth in claim 1, further comprising means for individually controlling the flush gas supplied to each flushing plate.

10. A flushing arrangement as set forth in claim 1 wherein the metal walls of said flushing wall comprise a pair of spaced-apart metal plates.

11. A flushing arrangement as set forth in claim 10, wherein said flushing plate has rims welded together so as to be gas-tight.

12. A flushing arrangement as set forth in claim 1 wherein the metal walls of said flushing plate comprise a plurality of elongated hollow pipes arranged adjacent each other in a row, all of said pipes being coupled to said supply duct to form said flushing plate.

* * * * *